United States Patent [19]

Reed

[11] Patent Number: 4,879,003

[45] Date of Patent: Nov. 7, 1989

[54] SLICE LIP PROTECTOR SYSTEM

[75] Inventor: Gordon K. Reed, Bexley, Ohio

[73] Assignee: Process Automation Business, Inc., Columbus, Ohio

[21] Appl. No.: 334,497

[22] Filed: Apr. 7, 1989

[51] Int. Cl.[4] ..... D21F 1/06

[52] U.S. Cl. ..... 162/344; 162/259; 162/336; 162/347

[58] Field of Search ..... 162/259, 336, 344, 347

[56] References Cited

FOREIGN PATENT DOCUMENTS 2607822 8/1977 Fed. Rep. of Germany ..... 162/344

*Primary Examiner*—Karen Hastings

*Attorney, Agent, or Firm*—John H. Mulholland

[57] ABSTRACT

A paper machine headbox slice lip rotector system which permits limited incremental movement up or down by means of a pivoting lever arm 32 with lock bolt end portions 36 and 38 moving in adjacent protectors' adjustable keeper recesses 40. The recesses 40 are defined by stop nuts 42 on a threaded body fixed to the adjustable spindles 20. The lever arm 32 is pivotally mounted on the body for permitting up and down movement a distance which is the average of the distance defined by the keeper recesses 40 of the adjacent protectors. This prevents the prior art problem of a protector being "locked" between adjacent protectors.

6 Claims, 2 Drawing Sheets

SLICE LIP PROTECTOR SYSTEM

BACKGROUND OF THE INVENTION

This invention relates to the profile adjustment of a slice lip of a paper machine headbox. In papermaking, the slice opening of a headbox on a paper machine meters flow of the pulp slurry or stock in the headbox onto the fourdrinier wire. A number of axially movable spindles, perhaps 50 to 60, are connected to a headbox control lip or slice lip to vary the metering opening transversely across the machine. The spindles, typically, are threadedly attached at their upper ends to rotationally driven power nuts which linearly drive the individual spindles axially in known manner. The slice lip positional accuracy permits the production control of quality paper by basis weight profiles through the elimination of cross-machine variations.

In adjusting the slice lip, however, care must be taken to have coordinated, gradual adjustments in order to avoid producing "lip kinking" or other force-applied damage to the delicate slice lip. Slice lip protector systems for this purpose are known. One such slice lip protector system permits limited incremental slice lip actuator movement through a series of adjacent slice profiling spindles having mechanically interconnected protectors mounted thereon. The problem with this system, however, is that it permits only first order bend limits which permit a given protector movement up or down a given distance from the position of either of two adjacent mechanically interconnected protectors, one on each side thereof, as will be seen hereinafter.

The system referred to just above is sold by the Black Clawson Paper Machine Group of Watertown, N.Y. 13601 as part of the automatic slice profiling system it sells under the trademark "ESP" II.

SUMMARY OF THE INVENTION

In a paper machine headbox slice lip protector system permitting limited incremental slice lip actuator movement through a series of adjacent slice profiling spindles having mechanically interconnected protectors mounted thereon, the present invention provides passive second order bend limits. It therefore overcomes the disadvantage in known mechanically interconnected protectors which permit only first order bend limits wherein each spindle and protector mounted thereon can move only up or down a predetermined distance from the position of either of the adjacent protectors on its opposite sides. The undesirable result of which on long unstressed slopes is that movement of the middle protector is not permitted if the adjacent protectors are located at the bend limit, even though the middle protector could move up or down safely, without damage to the slice lip.

The improvement of the instant invention is accomplished by means of interconnected protectors which each include an elongated lever member centrally pivoted on a hollow body attached to each of the spindles. The lever members have lock bolt portions on their opposite ends for engagement in and mechanical interconnection with keeper recesses defined by stop means in the form of nuts mounted on a threaded exterior portion of the hollow body mounted on each of the opposite side's adjacent spindles. The stop nuts are held in proper axially adjusted position by means of jam nuts which are also threadedly engaged with the body.

The stop nuts are adjusted to permit the pivoted lever of one spindle to move in the keeper recesses of the bodies mounted on the two adjacent spindles to permit the one spindle to move up or down within limits established by the adjustment. On long unstressed slopes, this movement of the protectors permits movement of the one spindle within safe limits which do not damage the slice lip. Thus, a passive control is provided whether the axial spindle movement is either manually or automatically controlled.

DETAILED DESCRIPTION OF THE DRAWINGS

Figure 1:
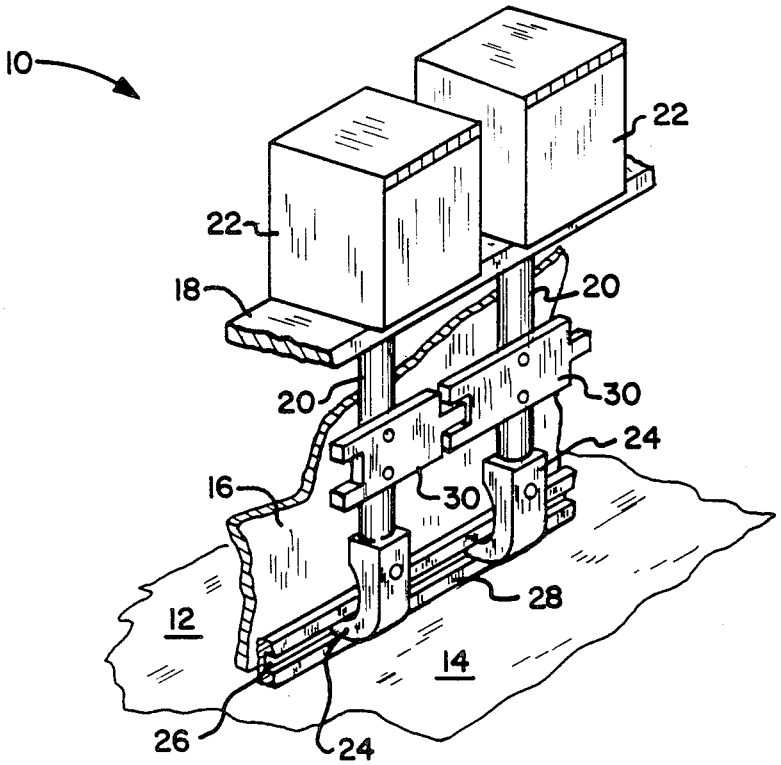
Fig. 1 (PRIOR ART)
FIG. 1 is a fragmentary and schematic perspective view of a portion of a paper machine headbox with a slice lip metering the stock therefrom and prior art mechanically interconnected protectors mounted on adjacent spindles.

The numeral 10 generally designates a paper machine headbox slice lip system for metering the stock 12 from a headbox 12 onto a fourdrinier wire to form a paper web 14.

The stock-containing headbox has a front wall 16 from which extends a base plate 18. The base plate 18 has openings (not shown) through which axially adjustable spindles 20 extend. At the upper end of the spindles 20, supported by the base plate 18, are enclosures 22 which house the actuators for axially adjusting the spindles 20.

Fixed to the lower ends of spindles 20 are hooks 24 or other suitable mechanical means for engaging a groove 26 in the slice lip 28. Axial movement of a spindle 20 in response to the actuator within an enclosure 22 moves that segmental portion of the slice lip 28 length. The slice lip 28 is thus adjusted across the machine at, typically, 60 locations to determine its metering profile of stock 12 and the resultant profile and basis weight of web 14.

If during adjustment, particularly along a long unstressed slope of slice-lip 28, adjacent spindles are moved at extremely different axially adjusted positions, a kink or other damage to the slice lip 28 can occur. Such a kink, obviously, will ruin the quality of paper web 14. Accordingly, mechanically interconnected protectors 30 have been mounted on the spindles 20 to limit permitted relative axial positions of adjacent spindles 20.

Figure 2:
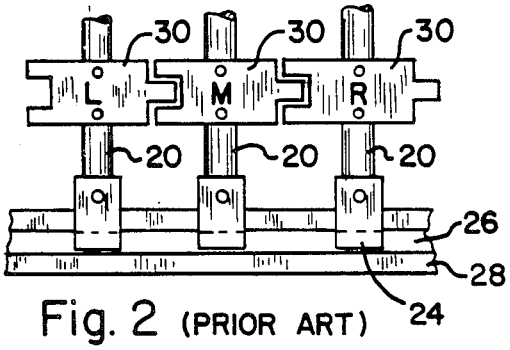
Fig. 2 (PRIOR ART)
FIG. 2 is a fragmentary and schematic elevational view of the prior art system of mechanically interconnected protectors mounted on adjacent spindles.
Figure 3:
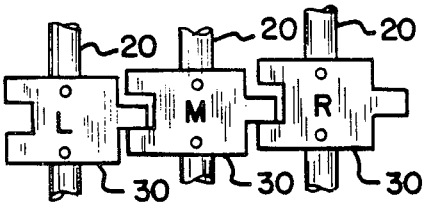
Fig. 3 (PRIOR ART)
FIG. 3 is a view similar to FIG. 2 with the prior art protectors in the position they would take in the event they were connected to a long unstressed sloped portion of the slice lip, showing the disadvantage in that the middle protector has no potential for adjusting movement relative to its adjacent protectors.

As seen in FIGS. 2 and 3, the prior art protectors 30 are labelled "M" for middle, "L" for left and "R" for right. In FIG. 2 the spindles are all in the same axial position. In FIG. 3 the illustrated portion of slice lip 28 is in a long unstressed slope condition of adjustment with spindles "L" and "R" at the bend limit. The "M" protector could safely move up or down for a more finely adjusted slice lip profile but protector "M" cannot move up because of protector "L" and cannot move down because of protector "R".

The protectors 30' of the invention are illustrated in FIGS. 4–7 and they provide passive second order bend limits rather than the first order bend limits provided by protectors 30, as explained above.

Protectors 30, are hollow bodies which are fixed on spindles 20 and which each have an elongated lever member 32 centrally pivoted at a pivot 34 on the body. Opposite end portions of each lever 32 are shaped to act as lock bolts 36 and 38, 36 on the left end of the lever and 38 on the right end. The lock bolts 36 and 38 ride in keeper recesses 40 defined by nuts 42 which are threaded on the outside of the hollow bodies. The levers 32 are free to pivot at 34 because the central openings 44 therein are large enough to permit both clockwise and counterclockwise travel of lock bolts 36 and 38 within their keeper recesses 40 defined by nuts 42 and locked in place on the threaded body of the adjacent protector 30, by means of jam nuts 46.

Figure 4:
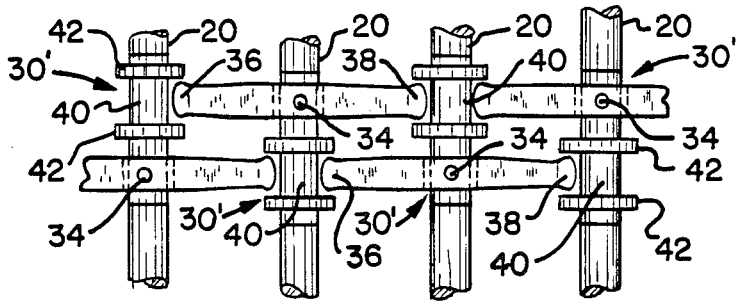
FIG. 4 is a fragmentary and schematic elevational view of a system of mechanically interconnected protectors provided in accordance with the principles of the invention and mounted on adjacent spindles.
Figure 5:
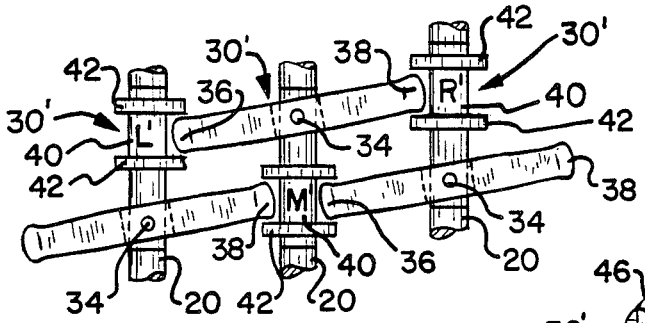
FIG. 5 is a view similar to FIG. 4 with the protectors of the invention in the position they would take in the event they were connected to a long unstressed sloped portion of the slice lip, showing the advantage that the middle protector is permitted to be moved relative to its adjacent protectors for adjusting movement of the slice lip.
Figure 6:
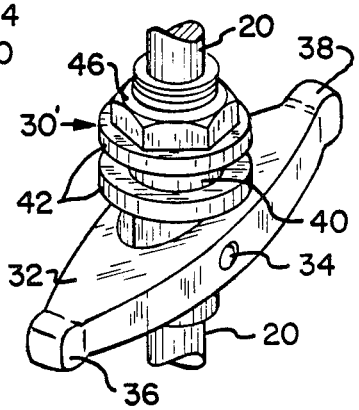
FIG. 6 is a perspective schematic view of a protector for mounting on a spindle in accordance with the principals of the invention, including a pivoted lever, stops and a jam nut mounted thereon.
Figure 7:
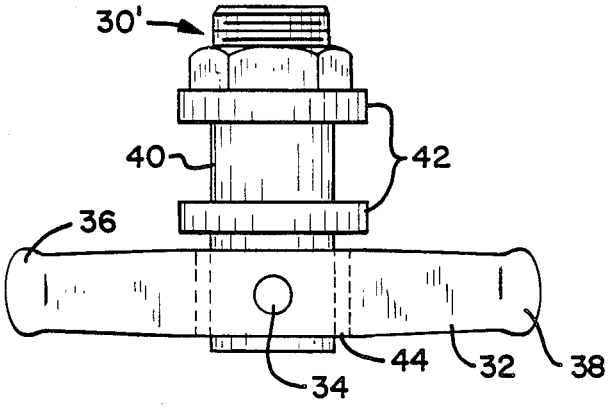
FIG. 7 is a front, elevational schematic view of the protector of FIG. 6.

The invention is arranged as shown in FIG. 4 to start, and then, the actuators in housing 22 are utilized to adjust the slice lip through axial movement of spindles 20. On long unstressed slopes similar to that referred to in connection with prior art FIG. 3, the middle protector "M'", as shown in FIG. 5, is permitted additional incremental safe movement for adjustment of the slice lip. This is because the middle protector M' and its spindle 20 can move up or down a distance which is the average of the keeper recess 40 of protector L' and and keeper recess 40 of protector R' as defined by their respective stop means nuts 42. Notice the pivots 34 are alternately above and below the keeper recesses 40 of the adjusted protectors 30'.

With the arrangement of the invention substantially as shown, the problem of the captured middle protector M of FIG. 3 is obviated. Thus, an absolutely fail-safe slice lip protector system for use with either manual or automatic actuator systems is provided.

We claim:

1. In a paper machine headbox slice lip protector system permitting limited incremental slice lip actuator movement through a series of adjacent slice profiling spindles having mechanically interconnected protectors mounted thereon, the improvement comprising:

said interconnected protectors each including an elongated lever member centrally pivoted on one of said spindles;

lock bolts on the opposite ends of said lever member;

stop means mounted on the spindles;

said stop means defining a keeper recess into which said lock bolts of adjacent protectors extend to form a mechanical interconnection;

whereby the one spindle is permitted to move up or down within limits established by the adjacent keeper recesses as the lever member pivots.

2. The system of claim 1 in which the stop means are adjustable to vary the amount of pivotal movement of the lock bolts within the keeper recesses, whereby the permitted spindle movement up and down relative to adjacent spindles may be varied.

3. The system of claim 1 in which the stop means and pivoted lever member mounted on a spindle are mounted on a common hollow body attached to the spindle.

4. The system of claim 3 in which the common hollow body has threads for axial adjustment of the keeper recess defining stops.

5. The system of claim 4 in which the stop means are locked in place by jam nuts.

6. The system of claim 1 in which the lever member pivots are alternately above and below the keeper recesses of adjacent spindles.

* * * * *